US011779977B2

(12) United States Patent
Sprock et al.

(10) Patent No.: US 11,779,977 B2
(45) Date of Patent: Oct. 10, 2023

(54) METHOD FOR SETTING DIFFERENT COOLING CURVES OF ROLLING MATERIAL OVER THE STRIP WIDTH OF A COOLING STRETCH IN A HOT-STRIP MILL OR HEAVY-PLATE MILL

(71) Applicant: SMS group GmbH, Düsseldorf (DE)

(72) Inventors: August Sprock, Düsseldorf (DE); Christoph Hassel, Duisburg (DE); Carsten Andreas Klein, Düsseldorf (DE)

(73) Assignee: SMS group GmbH, Düsseldorf (DE)

( * ) Notice: Subject to any disclaimer, the term of this patent is extended or adjusted under 35 U.S.C. 154(b) by 225 days.

(21) Appl. No.: 17/310,730

(22) PCT Filed: Feb. 19, 2020

(86) PCT No.: PCT/EP2020/054366

§ 371 (c)(1),
(2) Date: Aug. 19, 2021

(87) PCT Pub. No.: WO2020/169669

PCT Pub. Date: Aug. 27, 2020

(65) Prior Publication Data

US 2022/0126343 A1 Apr. 28, 2022

(30) Foreign Application Priority Data

Feb. 21, 2019 (DE) ..... 10 2019 104 419.7

(51) Int. Cl.
*B21B 37/76* (2006.01)
*B21B 45/02* (2006.01)
(Continued)

(52) U.S. Cl.
CPC ..... *B21B 37/76* (2013.01); *B21B 1/24* (2013.01); *B21B 45/0218* (2013.01); *C21D 8/0263* (2013.01); *C21D 2221/00* (2013.01)

(58) Field of Classification Search
CPC . B21B 45/0203; B21B 45/0218; B21B 37/74; B21B 37/76
See application file for complete search history.

(56) References Cited

U.S. PATENT DOCUMENTS

2003/0089431 A1 5/2003 Gramckow et al.
2006/0225474 A1 10/2006 Reinschke et al.
(Continued)

FOREIGN PATENT DOCUMENTS

DE 102008011303 6/2013
EP 2287345 A1 2/2011
(Continued)

*Primary Examiner* — Bobby Yeonjin Kim
(74) *Attorney, Agent, or Firm* — Smartpat PLC

(57) ABSTRACT

A method for setting different cooling rates of metal strips or metal plates (rolling material) over the strip width of a cooling stretch in a hot-strip mill or heavy-plate mill is presented. According to the method, for the calculation of the cooling rate, the initial enthalpy distribution over the material width of the rolling material before the cooling is determined. Proceeding therefrom, a target enthalpy distribution is determined in the width direction and length direction of the rolling material while taking into account a calculation of the flatness and the mechanical properties by means of a microstructure model. Subsequently, the coolant amount and the coolant curve of the cooling stretch are set.

7 Claims, 3 Drawing Sheets

(51) Int. Cl.
*B21B 1/24* (2006.01)
*C21D 8/02* (2006.01)

(56) References Cited

U.S. PATENT DOCUMENTS

| | | | | |
|---|---|---|---|---|
| 2010/0332015 | A1 | 12/2010 | Weinzierl | |
| 2014/0250963 | A1 | 9/2014 | Nelson et al. | |
| 2016/0346822 | A1* | 12/2016 | Weinzierl | B21B 37/76 |
| 2017/0327925 | A1* | 11/2017 | Watson | B21B 1/22 |
| 2021/0245215 | A1* | 8/2021 | Weinzierl | B21B 37/74 |

FOREIGN PATENT DOCUMENTS

| | | | |
|---|---|---|---|
| JP | S6462208 | A | 3/1989 |
| WO | 2004076085 | A2 | 9/2004 |
| WO | 2009106423 | A1 | 9/2009 |
| WO | 2014164115 | A1 | 10/2014 |
| WO | 2015113825 | A1 | 8/2015 |

* cited by examiner

METHOD FOR SETTING DIFFERENT COOLING CURVES OF ROLLING MATERIAL OVER THE STRIP WIDTH OF A COOLING STRETCH IN A HOT-STRIP MILL OR HEAVY-PLATE MILL

CROSS-REFERENCE TO RELATED APPLICATION

This application is a national stage application, filed under 35 U.S.C. § 371, of International Patent Application No. PCT/EP2020/054366, filed on 2020 Feb. 19, which claims the benefit of German Patent Application No. 10 2019 104 419.7, filed 2019 Feb. 21.

TECHNICAL FIELD

The disclosure relates to a method for setting the cooling curve of metal strips or metal plates (rolling material) over the strip width of a cooling stretch, for example in a hot-strip mill or heavy-plate mill or cooling in a continuous annealing/heat treatment line.

BACKGROUND

Cooling plays an important role in improving the quality of hot strip or heavy plate. For this purpose, the targeted computer-aided control of the cooling is known, for example, to prevent the strips or plates from bending and/or bulging. In the absence of control and regulation of the temperature, it is thus no longer possible to set the desired qualities. If the bend or bulge of the strips or plates is too pronounced, it may not be possible to correct the strips or plates in a subsequent roller table in a manner that would ensure quality. The consequences are strip defects and an associated increase in scrap.

In order to avoid this, processes for cooling rolling material are known, with which a control device for the rolling material determines and sets the optimum coolant amount and coolant amount curve for passage through a cooling stretch. This is to ensure optimum flatness and evenness of the rolling material to be cooled.

A disadvantage of this is that the strip width ranges are specifically cooled differently, in order to improve the flatness of the strip or plate. This is done taking into account measured temperatures, but taken from the surface. After cooling, the temperature distribution in the strip or plate is precisely not homogeneous and therefore not meaningful in terms of the actual energy content in the material.

From DE 10 2008 011 303 B4, the energy content of the rolling material to be cooled is taken into account as an input variable for controlling the cooling stretch and determining the amount of coolant, in order to remove a specific amount of heat from the rolling material. Here, a single, fixed value is always assumed as the start and target values. Furthermore, no indication on how to set the target size is given.

SUMMARY

It is the object of the present disclosure to provide an improved method for controlling and setting the flatness or evenness, and/or the mechanical properties of the rolling material in a hot-strip mill or heavy-plate mill.

This object is achieved by determining the initial enthalpy distribution over the material width of the rolling material before cooling. Based thereon, for the calculation of the cooling, a target enthalpy distribution is determined in the width and length direction of the rolling material while taking into account a calculation of the flatness and the mechanical properties by means of a microstructure model, and subsequently the coolant amount and the coolant curve of the cooling stretch are set.

Based on an enthalpy distribution over the width at the beginning of the cooling stretch, a target enthalpy distribution over the width downstream of the cooling stretch is determined. Thereby, the input enthalpy distribution can be determined from a computer program, for example. In principle, another thermodynamic potential can be used instead of enthalpy.

The target enthalpy distribution can be defined using various parameters. This is, for example, a numerical calculation of the evenness of the strip downstream of the cooling stretch, which can be optimized based on the target value. With the aid of modeling, it is in principle also possible to calculate the evenness of the finished product in the cold state (that is, after coil cooling). This is not possible with the help of a measuring device in warm condition. Another option is to specify this via a microstructure model so that the goal of setting homogeneous mechanical properties over the width can be met. This is not necessarily the case with uniform cooling, and this is not necessarily the case with uniform enthalpy distribution over the width. Furthermore, the results of various measuring devices that measure a quality variable as a function of width can also be taken as control parameters. This can be, for example, a flatness measuring roller or another flatness measuring device, but also measuring devices for recording mechanical properties (for example, Impoc or others).

A wide variety of measures can be used as actuators within the cooling stretch, allowing different enthalpies to be achieved depending on the width. This can be, for example, edge masking, the heating of edges, the targeted cooling by multiple control loops over the width or the like.

The target enthalpy distribution can also be determined by optimizing other parameters or empirically on the basis of measurements after cooling. In doing so, starting from the initial enthalpy distribution, the target enthalpy distribution can be set inhomogeneously over the width. A control system can dynamically change the target enthalpy distribution in the rolling material over the width during the rolling material run through the cooling stretch. The enthalpy calculation can be based on Gibbs energy, for example.

Databases in the SGTE (Scientific Group on Thermodata Europe and MatCalc database) can be used to determine the Gibbs energy, for example, in order to specify the microstructural constituents in the rolling material and to set the cooling to a constant microstructural phase fraction homogeneously distributed over the strip width of the rolling material, thus regulating and controlling the mechanical properties as a function of the target enthalpy distribution.

Via a measuring point arranged downstream of the cooling, an immediate comparison with the mechanical properties calculated in the microstructure model can be made, and thus a possible deviation of the target enthalpy distribution can be corrected immediately by activating or deactivating the cooling.

The invention will be explained in more detail below with reference to the drawings.

DETAILED DESCRIPTION

Figure 1:
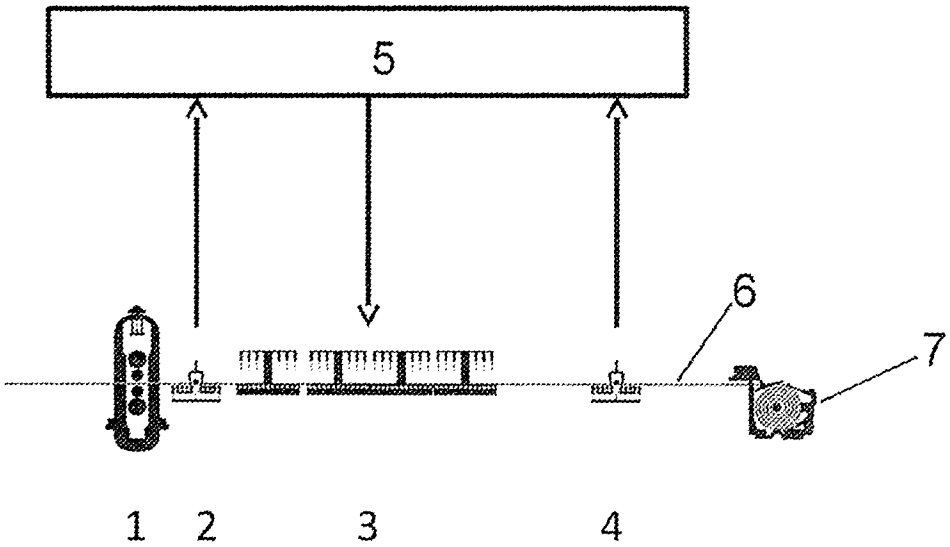
FIG. 1 is a schematic illustration of the system and the flow concept.

FIG. 1 schematically shows a part of a possible hot-strip line or heavy-plate line for processing metal strips and/or metal plates. A measuring device 2 is arranged downstream of the last stand 1 of the hot-strip line or heavy-plate line. The measuring device 2 can be a flatness roller or the like, and is located upstream of the actual cooling stretch 3. The measuring device records an actual value of the rolling material 6 upstream of the cooling stretch 3.

The cooling stretch 3 can include laminar cooling or amplified cooling or compact cooling. Downstream of the cooling stretch 3, at least one further measuring device 4, for example a flatness roller or similar, is arranged to measure the actual value, for example the flatness, of the hot strip/rolling material 6 after it has passed through the cooling stretch 3.

A computer model 5 receives the measured data from the measuring devices 2 and 4 and specifies cooling medium amounts of the cooling stretch 3 to be used accordingly for setting the target enthalpy distribution. In this way, it can be ensured quasi online that the desired qualities of the rolling material/hot strip 6 may be adjusted and then can be immediately wound up into a coil 7 for further processing. Other units, for example, more measuring devices, descalers, thermal insulation hoods, shears, etc., may be arranged in the region upstream and downstream of the cooling 3.

Figure 2:
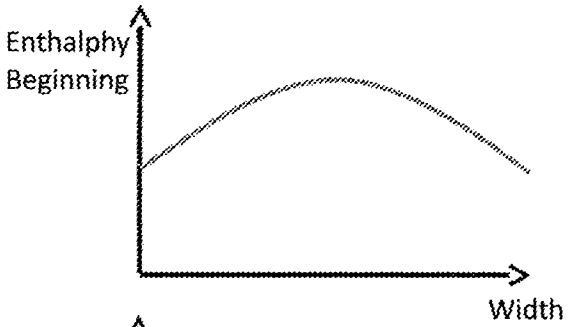
FIG. 2 is an illustration of the inflowing enthalpy distribution (upper image)
Figure 2A:
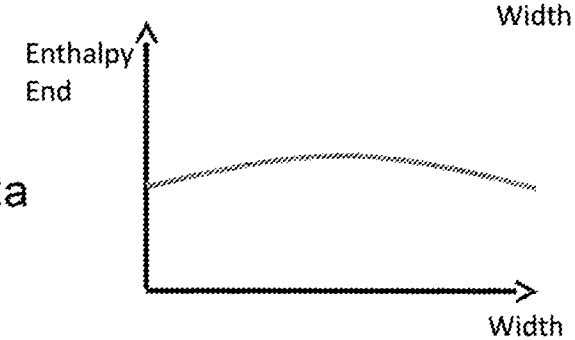
FIG. 2*a* shows the target enthalpy distribution (middle image)
Figure 2B:
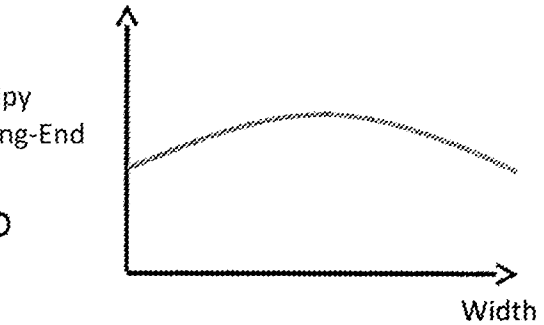
FIG. 2*b* shows the difference of the two enthalpy distributions viewed over the width of the rolling material.

FIGS. 2, 2*a*, 2*b* illustrate the enthalpy distribution in the hot strip as viewed over the width at the beginning of the recording and at the end of the recording, along with the difference of both enthalpies at beginning and end.

Figure 3:
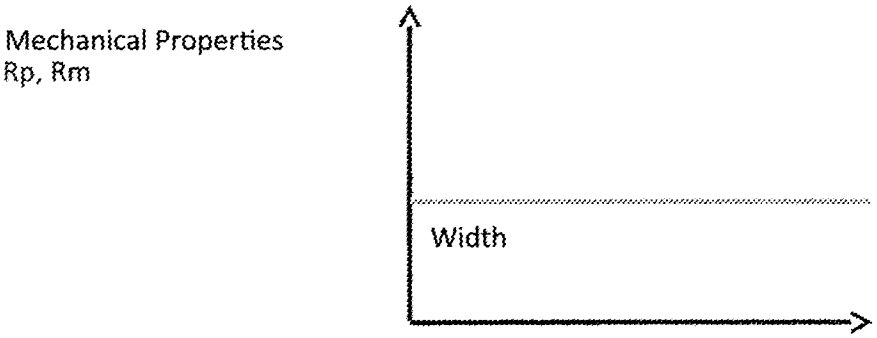
FIG. 3 is an illustration of possible target distributions for the mechanical properties.
Figure 3A:
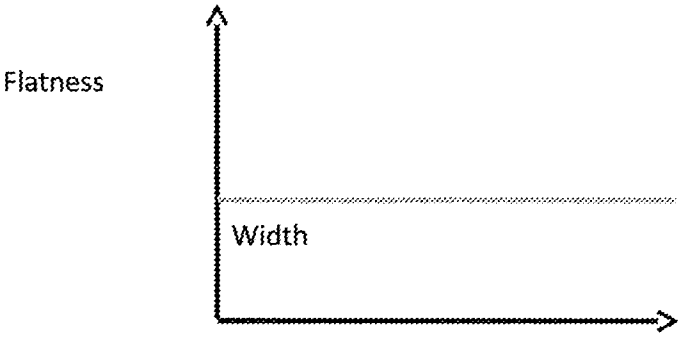
FIG. 3*a* shows the flatness viewed over the width.

FIG. 3 illustrates the mechanical properties of yield strength and tensile strength (Rp and Rm) over the width of the hot strip. FIG. 3*a* illustrates the flatness of the rolling material as viewed over the width.

REFERENCE SIGNS

1 Last stand
2 Measuring device upstream of the cooling stretch
3 Cooling stretch
4 Measuring device downstream of the cooling stretch
5 Model (calculation model)
6 Rolling material/hot strip
7 Coil/reel

The invention claimed is:

1. A method for setting a cooling curve of rolled metal strips or rolled metal plates over a strip width of a cooling stretch in a hot-strip mill or heavy-plate mill or cooling in a continuous annealing/heat treatment line, comprising:

determining an initial enthalpy distribution over the material width of the rolling material before cooling;

determining, based on the initial enthalpy distribution, a target enthalpy distribution in the width and length direction of the rolling material while taking into account a calculation of the flatness and the mechanical properties by a microstructure model; and subsequently setting a coolant amount and the coolant curve of the cooling stretch.

2. The method according to claim 1, wherein, starting from the initial enthalpy distribution, the target enthalpy distribution is set inhomogeneously over the width.

3. The method according to claim 2, further comprising:

dynamically changing the initial enthalpy distribution during the strip run; and accordingly and subsequently recalculating the coolant amount.

4. The method according to claim 3, wherein a control system dynamically changes the target enthalpy distribution in the rolling material over the width during the rolling material run.

5. The method according to claim 4, wherein the enthalpy determination is based on Gibbs energy.

6. The method according to claim 5, wherein for the determination of enthalpy based on Gibbs energy, databases in the SGTE (Scientific Group on Thermodata Europe) are used, in order to specify the microstructural constituents in the rolling material, and wherein the cooling is regulated and controlled to a constant microstructural phase fraction homogeneously distributed over the strip width of the rolling material as a function of the target enthalpy distribution.

7. The method according to claim 6, wherein an immediate comparison with the mechanical properties calculated in the microstructure model is made via a measuring point and, as a result, a possible deviation of the target enthalpy distribution is corrected immediately by activating or deactivating the cooling.

* * * * *